US005090602A

United States Patent [19]

Link

[11] Patent Number: 5,090,602

[45] Date of Patent: Feb. 25, 1992

[54] FLEXIBLE POUR SPOUT

[75] Inventor: Paul A. Link, Wisconsin Rapids, Wis.

[73] Assignee: Pal Products, Inc., Wisconsin Rapids, Wis.

[21] Appl. No.: 390,744

[22] Filed: Aug. 8, 1989

[51] Int. Cl.[5] ..... B67D 5/38

[52] U.S. Cl. ..... 222/527; 222/527; 285/921

[58] Field of Search ..... 222/21, 204, 554, 56 L, 222/563, 23, 568, 569, 239, 159, 166, 632, 527, 528, 529, 530; 285/354, 423, 386, 387, 388, 921

[56] References Cited

U.S. PATENT DOCUMENTS

| | | | |
|---|---|---|---|
| 949,395 | 2/1910 | Eaton . | |
| 1,153,998 | 9/1915 | Canby . | |
| 1,433,518 | 10/1922 | Kraft | 285/386 |
| 1,761,072 | 6/1930 | Dohrmann . | |
| 2,033,931 | 3/1936 | Erne . | |
| 2,185,741 | 1/1940 | Sorg'et al. | 222/527 |
| 2,522,486 | 9/1950 | Sokolik | 222/566 |
| 2,556,627 | 6/1951 | Miksis | 222/568 |
| 2,630,247 | 3/1953 | Rafferty | 222/159 |
| 2,792,976 | 5/1957 | Stewart | 222/569 |
| 2,904,232 | 9/1959 | Gersten | 222/539 |
| 3,047,195 | 7/1962 | Richmond | 222/570 |
| 4,129,236 | 12/1978 | Wrycraft et al. | 222/568 |
| 4,583,668 | 4/1986 | Maynard, Jr. | 222/568 |
| 4,679,827 | 7/1987 | Law | 285/921 |
| 4,690,375 | 9/1987 | Vorhis | 222/529 |
| 4,832,238 | 5/1989 | Taylor | 222/529 |

FOREIGN PATENT DOCUMENTS

| | | | |
|---|---|---|---|
| 252652 | 6/1926 | United Kingdom | 222/530 |
| 2089314 | 6/1982 | United Kingdom | 222/530 |

*Primary Examiner*—Michael S. Huppert
*Assistant Examiner*—Philippe Derakshani
*Attorney, Agent, or Firm*—Foley & Lardner

[57] ABSTRACT

A flexible pour spout for transferring fluid from a container includes a resiliently deformable conduit having a closure cap removably attached at one end to prevent leakage of residual fluid during non-use and a threaded fitting frictionally engaged at the other end to permit fluid communication with the container. The fitting is comprised of a fastener and a spool having complementary bearing surfaces which permit a snap fit and may include a washer for sealing the interface between the container and the conduit.

14 Claims, 3 Drawing Sheets

FLEXIBLE POUR SPOUT

TECHNICAL FIELD

The present invention relates, generally, to apparatus for transferring fluid from one container into another, and more particularly, to a self-contained flexible spout configured for use in conjunction with prepackaged fluid containers of the type having an integral threaded nozzle. A specific implementation of the present invention utilizes a fitting having integral threads compatable with the external threads typically associated with quart or liter size units of automotive oil. A transparent, resiliently deformable conduit connected to the fitting facilitates selective inhibition of flow and provides visible indicia of fluid flow.

BACKGROUND ART AND TECHNICAL PROBLEMS

Dispensing spouts for pouring fluid from a container are well known. For example, Eaton U.S. Pat. No. 949,395 issued Feb. 15, 1910, discloses a spout adapted to be placed above the discharge opening of a keg, including a tapered nozzle and a removable cap for closure of the spout.

Canby U.S. Pat. No. 1,153,998 issued Sept. 21, 1915, discloses a spout which extends obliquely from a central opening of a base having a lateral flange arranged to frictionally engage a corresponding flange in the nozzle of the container.

Stewart U.S. Pat. No. 2,792,976 issued May 21, 1957 discloses a spout for a container wherein a flexible tube may be frictionally secured to the spout.

Sokolik U.S. Pat. No. 2,522,486 issued Sept. 12, 1950 discloses a pouring regulating spout having a narrow but high passageway, the area of which is equal to the round opening of the bottle to which the spout is secured, thereby allowing the operator to quickly reduce the flow through the spout by tipping the body of the bottle. The '486 patent suggests that the device may be made from plastic material, and that "[f] or clear liquids, transparent material would be preferable, but for colored liquids certain color combinations would be attractive." (Column 3, lines 20–25).

It is also known to provide the portion of the transfer apparatus which interfaces with the spout of the container from which fluid is dispensed with internal threads or corrugations for attaching the device to the nozzle. Dohrmann U.S. Pat. No. 1,761,072 issued June 3, 1930, discloses a container having a corrugated flexible spout which is adapted to be housed within the container during non-use.

Miksis U.S. Pat. No. 2,556,627 issued June 12, 1951, discloses an adapter for a fuel can spout for accommodating nozzles of different diameters. The '627 device includes a stepped socket having outer, intermediate, and inner portions of progressively reduced diameters for receiving nozzles of different sizes. Each of the sleeves of the socket is internally threaded to receive the corresponding externally threaded nozzle of the container from which the fluid is dispensed. A flexible conduit threadedly engages the stepped socket for providing fluid communication therewith.

Gersten U.S. Pat. No. 2,904,232, issued Sept. 15, 1959, discloses a flexible pouring spout having a threaded fitting at one end for engaging the nozzle of the container from which fluid is dispensed, and further having a closure cap disposed at the other end of the spout to prevent fluid flow during non-use.

Presently known fluid transfer devices having particular application to automotive fluids are unsatisfactory in several respects. For example, while it is desirable to provide a flexible conduit (hose), corrugated conduits are expensive to manufacture. Moreover, fluid dispensing apparatus which frictionally engage the container from which fluid is dispensed have a tendency to leak once the container is inverted prior to or upon completion of the filling process.

SUMMARY OF THE INVENTION

The present invention provides a device which ameliorates many of the shortcomings associated with existing devices and which is inexpensive to manufacture. A preferred embodiment of the present invention includes a conduit having a closure cap removably disposed at one end thereof and a fitting frictionally engaged to the other end. The closure cap inhibits leakage of residual fluid during non-use. The fitting comprises internal threads configured to accommodate the external threads typically associated with fluid container spouts. The fitting may include a resilient washer for preventing leakage at the interface of the transfer device and fluid container.

The flexible conduit is advantageously of circular cross-section and of smooth internal and external construction. The conduit material is selected to provide sufficient flexibility to frictionally engage the fitting and the closure cap and is suitably transparent to provide visible indicia of flow rate and to prohibit flow in response to manual deformation, for example by the operator's fingers.

BRIEF DESCRIPTION OF THE DRAWING

A preferred exemplary embodiment of the present invention will hereinafter be described in conjunction with the appended drawing, wherein like numerals denote like elements, and.

DETAILED DESCRIPTION OF A PREFERRED EXEMPLARY EMBODIMENT

Figure 1:
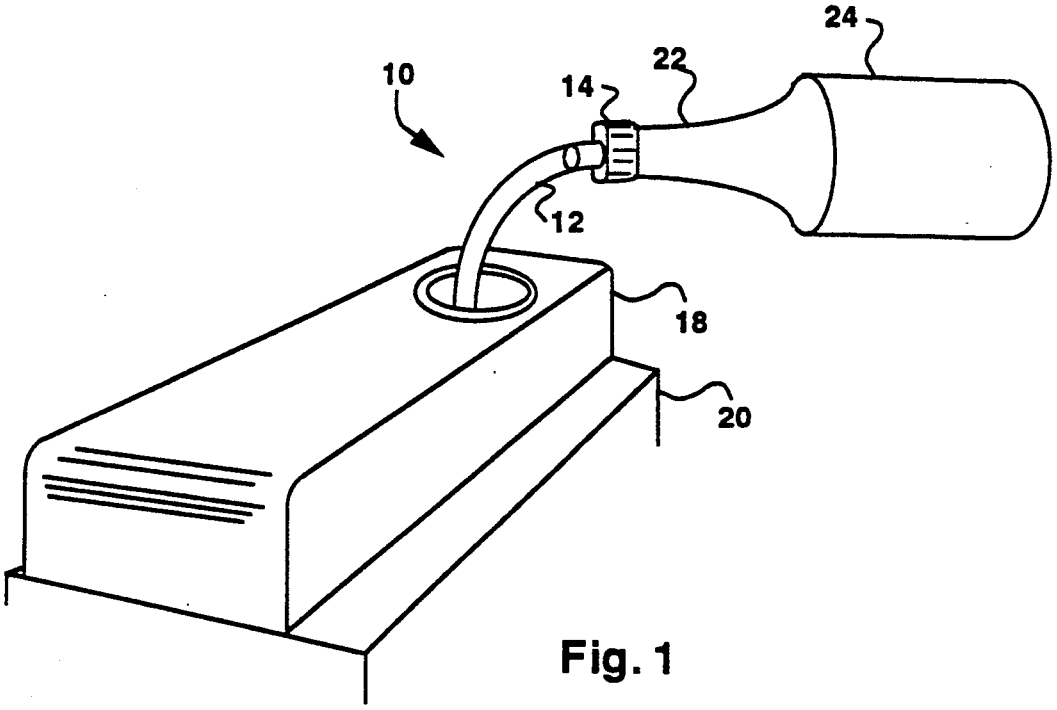
FIG. 1 is a perspective view of the fluid dispensing device in accordance with the present invention shown in fluid communication with a fluid container and the crankcase of an automotive engine.
Figure 2:
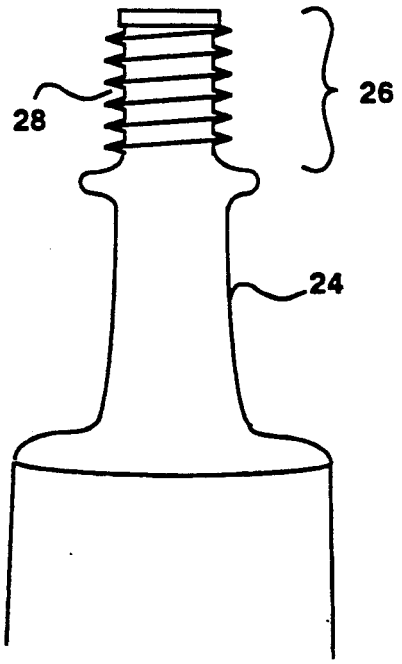
FIG. 2 is an enlarged view of the threaded portion of a nozzle of an exemplary fluid container.
Figure 3:
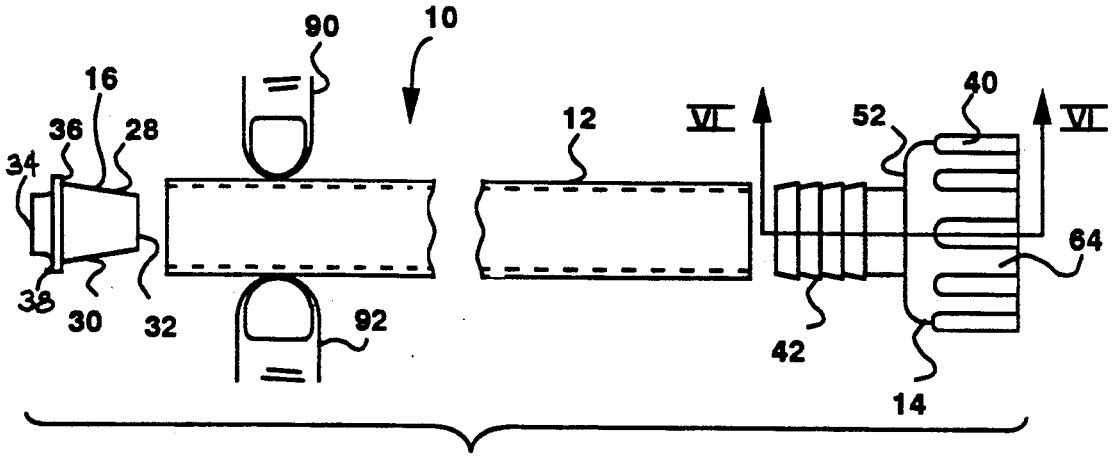
FIG. 3 is an exploded view of the cap, hose, and fitting in accordance with one aspect of the present invention.

With reference to FIGS. 1–3, a fluid dispensing device 10 in accordance with the present invention suitably comprises a flexible conduit 12, a closure cap 16 configured for frictional engagement with one end of hose 12, and a fitting 14 configured for frictional engagement with the opposite end of hose 12. Whereas cap 16 is removably disposed within conduit 12, fitting 14 is adapted to remain within conduit 12 during periods of use and non-use of device 10, except that fitting 14 may be removed from hose 12 to facilitate cleaning of the respective elements, as desired.

With particular reference to FIG. 1, hose 12 is advantageously about eight inches long, but may be of varying lengths, for example from between four inches to approximately 36 or more inches, to allow the distal end of hose 12 to be inserted within fluid receptacles which may be difficult to reach. In this regard, although a preferred embodiment of fluid dispensing device 10 is described herein with reference to a crankcase 18 of an automotive engine 20, fluid dispenser 10 may be used in connection with a wide variety of environments, including power steering reservoirs, radiators, transmissions, lawn mowers, snow mobiles, as well as many other industrial applications. Moreover, fluid dispenser 10 may be used to dispense granular, powdered, or any other substance capable of flowing through conduit 12.

With particular reference to FIGS. 1 and 2, fitting 14 is configured for threaded engagement with the nozzle portion 26 of a fluid container 24, for example, a quart or liter sized plastic vessel of oil, transmission fluid, or antifreeze/coolant. Container 24 typically comprises nozzle portion 26 having external threads 28 which are exposed when the cap is removed. As discussed in greater detail below, fitting 14 comprises corresponding internal threads which mate with external threads 28 to sealingly engage fitting 14 to container 24.

Figure 5A:
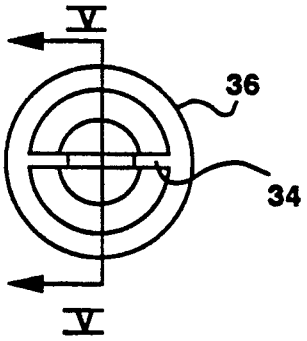
FIG. 5A is a top view of the cap shown in FIGS. 3 and 4.
Figure 5C:
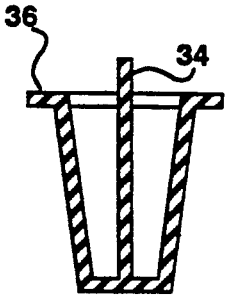
FIG. 5C is a cross-section view of the cap taken along line V—V of FIG. 5A.
Figure 5B:
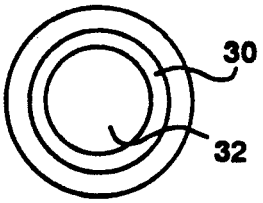
FIG. 5B is a bottom view of the cap shown in FIG. 5A.
Figure 4:
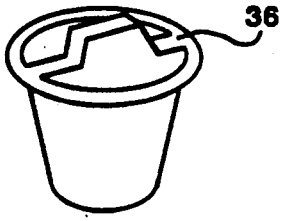
FIG. 4 is a perspective view of the cap shown in FIG. 3.

Referring now to FIGS. 3-5, cap 16 comprises a generally frusto-conical body 28 having an inclined wall 30 which terminates at a bottom 32. Body portion 28 is advantageously thin walled and hollow, having a planar projection 34 extending therefrom to allow manual manipulation of cap 16 into and out of conduit 12. Cap 16 is suitably made from polyethylene, polypropolyene, or various copolymers thereof, for example.

A circular flange 36 is disposed about the perimeter of the top portion 38 of cap 16, the flange serving as a stop which abuts against the end of hose 12, thereby limiting the extent to which cap 16 may be inserted into hose 12. Bottom portion 32 of cap 16 is suitably smaller in diameter than the inner diameter of hose 12 to facilitate insertion of cap 16 thereinto. Inclined wall 30 facilitates frictional engagement between cap 16 and hose 12 as cap 16 is urged thereinto. The outer perimeter of flange 36 advantageously exceeds the inner diameter of tube 12 to prevent cap 16 from being wholly inserted thereinto. On the other hand, if the diameter of flange 36 exceeds the outer diameter of tube 12 by a significant amount, cap 16 may be inadvertently dislodged from hose 12 during transportation or storage of device 10. Thus, it is desirable for the outer diameter of flange 36 to be approximately equal to the outer diameter of conduit 12.

Figure 6:
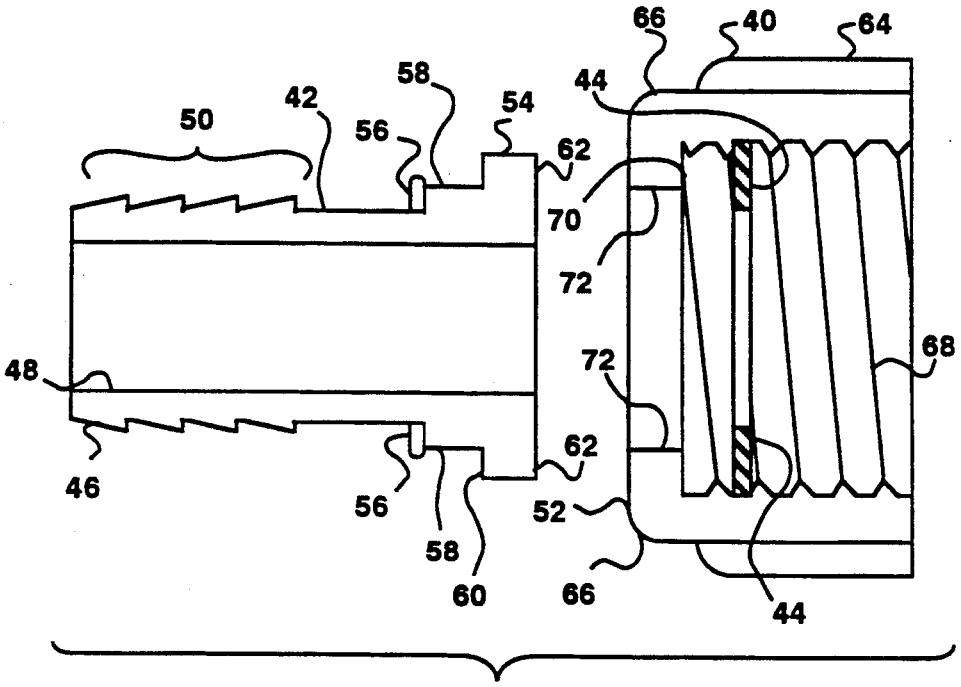
FIG. 6 is an exploded cross-sectional view of the fitting taken along line VI—VI in FIG. 3, including a washer disposed within the fitting.
Figure 7:
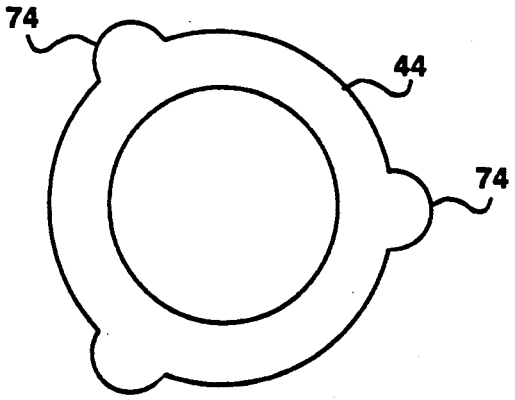
FIG. 7 is a top view of the washer shown in FIG. 6.

Referring now to FIGS. 3 and 6, fitting 14 illustratively comprises a fastener 40, a spool 42 received within and extending through an end of fastener 40, and a flexible washer 44, suitably a rubber washer. Spool 42 and fastener 40 are advantageously made from nylon or similar lightweight, rigid material.

Spool 42 comprises an annular shaft 46 defining a bore 48 extending therethrough. Bore 48 may be greater than, less than, or equal to the inner diameter of hose 12. A plurality of steps 50 extend from and are disposed about the perimeter of the distal portion of spool 42 for receipt within tube 12. Each step 50 forms an acute angle with the outer surface of spool 42, thus facilitating ease of insertion into tube 12. As the same time, angled steps 50 tend to "bite" the inner diameter of tube 12, thereby inhibiting removal of spool 42 from tube 12. In this regard, the outer diameter of shaft 46 (i.e., the diameter of steps 50) advantageously exceeds the inner diameter of hose 12 prior to insertion of spool 42 therewithin. In this way, the resiliently deformable material of hose 12 is expanded in response to insertion of spool 42 therewithin, forming a resilient interference fit between the hose and the spool. During assembly of fluid transfer device 10, fitting 14, including spool 42, is inserted into hose 12 until the end of hose 12 abuts shoulder 52 of fastener 40.

A radial flange 54 is suitably disposed at an end of spool 42 remote from steps 50. Flange 54 is defined by a first bearing surface 60 and a washer seat 62. Bearing surface 60 terminates at an outer radial guide surface 58 which has an outer diameter slightly greater than the remainder of shaft 46. A plurality of tangs 56 extend from spool 42 proximate the junction between guide surface 58 and the remainder of shaft 46. Tangs 56 operate to keep spool 42 secured within fastener 40, as discussed below.

With continued reference to FIGS. 3 and 6, fastener 40 advantageously includes a series of longitudinal splines 64 extending from the outer surface thereof to facilitate manual manipulation of fitting 14 about nozzle 26 of the fluid container (FIGS. 1 and 2). Splines 64 terminate at a radius portion 66 intermediate splines 64 and shoulder 52.

A series of internal threads 68 are incorporated into the inner diameter of fastener 40 to facilitate threaded engagement with external threads 28 of nozzle 26 (FIG. 2). Threads 68 accommodate threads 28, for example by mating engagement, cross threading or by engaging one or more of threads 68 within each flight of threads 28. If threads 68 are made from a sufficiently rigid material, they may be self-threaded upon threaded portion 26 of container 24, deforming external threads 28 on container 24 to sealingly engage the container.

The present inventor has determined that an ideal configuration for internal threads 68 comprises, for example, the threads typically associated with standard garden hose fittings. Indeed, the industry standard for the internal threads employed within fastener 40 are known as "FGHT" (female garden hose threads), having approximately 11.5 flights per inch and having an inner diameter of approximately 0.828 inches (2.10 cm) and an outer diameter of approximately 1.103 inches (2.80 cm).

Threads 68 terminate at a second bearing surface 70, against which first bearing surface 60 of flange 54 abuts. Bearing surface 70, in turn, terminates at an inner radial guide surface 72 which closely tracks outer radial guide surface 58 of spool 42 upon assembly of fitting 14. Guide surface 72 is approximately the same thickness as bearing surface 58, such that tangs 56 overlie shoulder 52 to securely hold flange 54 against surface 70.

Upon insertion of spool 42 within fastener 40, first bearing surface 60 rotatably contacts second bearing surface 70 and outer radial guide surface 58 rotatably contacts inner radial guide surface 72. Tangs 56 aid in retaining spool 42 within fastener 40 in a snap fit. A washer 44 is suitably inserted past threads 68 and seated on washer seat 62 of flange 54. The outer diameter of washer 44 closely tracks the inner diameter of threads 68. A plurality of resilient tangs 74 extend from the outer diameter of washer 44 and engage threads 68 when washer 44 is properly positioned against flange 54, thereby holding washer 44 in place. When fitting 14 is secured to nozzle 26 of container 24 (FIG. 2), washer 44, in conjunction with, for example, flange 54 and bearing surface 70, substantially prevent fluid from leaking out of fitting 14, particularly proximate shoulder 52.

Hose 12 is suitably made from a resiliently deformable material having a durometer in the range of 60–75, for example RNT 1065 available from Thermal Plastic Processes, Inc., of Sterling, N.J. In the preferred embodiment, the inner diameter of hose 12 ranges from approximately 0.5 to one inch, and most preferably approximately 0.750 inches. The outer diameter ranges from approximately 0.6 to 1.1 inches, and most preferably about 0.875 inches. RNT 1065 is also referred to in the industry as Industrial Grade PVC Tube Duro 68, i.e., having a durometer of 68. RNT 1065 exhibits a brittleness temperature of approximately −40° C., which is important in cold weather applications. Other properties of RNT 1065 include a specific gravity of approximately 1.2 (ASTM Test Method D792), a tensile strength of approximately 2,000 psi (ASTM D412), and a modulus of elasticity of approximately 800 psi (ASTM Test D412).

The hose material is suitably transparent to provide visual indicia of flow rate. In addition, when the fluid stored in container 24 is exposed to low temperatures, the viscosity of the fluid can increase to the point at which flow is substantially prevented through conduit 12. A transparent conduit allows easy verification of the absence of flow. The transparent hose also facilitates detection of flow cessation due to, for example, blockage in the flow path or emptying of the contents within container 24.

A further advantage of the present invention involves the ability of hose 12 to be resiliently deformed, for example, through the application of manual pressure by the operator's fingers 90 and 92 or by a clip or clothespin-like device, such that fluid flow is "choked off" for so long as pressure is applied. As an alternative to pinching or crimping hose 12, it can be bent into an acute angle, thereby preventing flow therethrough. Such controlled inhibition of hydraulic communication between respective opposite ends of conduit 12 is referred to as transient deformation. This feature is advantageous in the event an overflow condition is anticipated in the reservoir into which degrees of pinching or crimping can effectively throttle hose 12, thereby regulating the flow rate therethrough in a steady state condition.

A further advantage of the fluid transfer device in accordance with the present invention is the provision of a closed transfer system during periods of non-use. That is, when fitting 14 is secured to nozzle 26 and cap 16 is lodged within the distal end of hose 12, there are no paths through which fluid may leak.

A further advantage allows the operator to remove cap 16 and position the distal end of hose 12 within the fluid receptacle prior to inverting container 24. In this way, direct communication may be established between container 24 and the receptacle within which fluid is being transferred prior to initiation of flow, thereby greatly reducing the possibility of inadvertent spills, in contrast to existing devices which often require initiation of flow simultaneous with or prior to insertion of the distal end of the transfer device into the receptacle. Alternatively, the operator may bend hose 12, near the distal end thereof, into a V-shape while the distal end of the hose is positioned above or manipulated into the receiving receptacle. In this way, fluid container 24 may be inverted, as necessary, without spilling or leaking fluid before hydraulic communication is established between container 24 and the receiving receptacle.

Upon completion of the transfer of fluid into the receptacle, the distal end of hose 12 can be removed from the receptacle and cap 16 reinserted into the distal end of hose 12, thereby reestablishing a closed fluid path. In the event transfer device 10 is used solely for transferring oil into an engine crankcase, for example, there is no need to remove container 24 from the proximal end of the device during periods of non-use. This feature allows the device to be stored, for example, in the vehicle trunk without soiling articles which may come into contact with the device. When it is time to reuse the device, the empty container 24 is removed and discarded, and a new container 24 is secured to fitting 14.

It will be understood that the above description is of preferred exemplary embodiments of the present invention and that the invention is not limited to the specific forms shown. For example, washer 44 may be disposed intermediate respective bearing surfaces 60 and 70 and still perform its sealing function. This and other modifications may be made in the design and arrangement of the components without departing from the spirit of the invention as expressed in the appended claims.

I claim:

1. An apparatus for transferring fluid from a container of the type having a discharge orifice disposed at the distal end of a neck portion, the neck portion being in fluid communication with the interior of said container and having a substantially circular cross section and external threads disposed thereabout proximate said orifice, the apparatus comprising:

a resiliently deformable conduit having respective first and second ends and including means for inhibiting fluidic communication between said first and second ends in response to transient manual deformation of said conduit;

a spool sealingly and removably affixed within said first end of said conduit and communicating therewith, said spool having a first guide surface formed externally thereon; and a fastener snap fit around said spool and removably engageable with said external threads of said neck portion, said fastener being removable from said spool and having a second guide surface formed internally thereof, said first and second guide surfaces being in tracking relationship with each other to provide rotation between said spool and said fastener.

2. The apparatus of claim 1 wherein said conduit comprises a transparent flexible hose.

3. The apparatus of claim 1, further comprising an end cap frictionally but removably received within said second end of said conduit.

4. The apparatus of claim 1, wherein said conduit is made from a transparent material having a durometer in the range of about 60–75.

5. The apparatus of claim 1, wherein said conduit is made from transparent material having a durometer of about 68.

6. The apparatus of claim 1, wherein said conduit has an inner diameter of approximately 0.75 inches and an outer diameter of approximately 0.875 inches.

7. The apparatus of claim 1, wherein said apparatus further comprises:

said spool having radial projections configured for receipt within said first end of said conduit and further including a first bearing surface;

said fastener having internal threads configured for engagement with said external threads of said container, said fastener further including external splines spaced apart about the circumference thereof and a second bearing surface disposed adjacent said first bearing surface and configured to retain a portion of said spool within said fastener; and a resilient washer disposed within said fastener proximate said spool such that said washer is compressed between said orifice of said container and said spool when said fastener is secured to said container.

8. The apparatus of claim 1, wherein said conduit prevents separation of said spool and said fastener when said conduit is affixed to said spool.

9. The apparatus of claim 2, wherein said hose comprises smooth inner and outer surfaces.

10. The apparatus of claim 3, wherein either said spool or said fastener or both are made from nylon, said cap is made from the group consisting of polyethylene, polypropylene, and copolymers thereof, and said hose has a durometer of approximately 68 and a brittle temperature in the range of about −40° centigrade.

11. The apparatus of claim 3, wherein said end cap comprises a substantially frustoconical body portion and said conduit has a substantially circular cross section.

12. The apparatus of claim 6, wherein said conduit is approximately eight inches in length.

13. The apparatus of claim 11, wherein said conduit has an inner diameter in the range of about 0.5 to 0.8 inches and an outer diameter in the range of about 0.8 to 1.0 inches.

14. An apparatus for transferring fluid comprising:

a container from which said fluid is to be transferred, said container being of the type having a neck portion and a discharge orifice disposed at the distal end of said neck portion, said neck portion and said discharge orifice being in fluid communication with said container;

a resiliently deformable conduit having one end attachable to said neck portion and a second end free of said neck portion;

connecting means for releasably securing one end of said conduit to said neck portion to thereby permit fluidic communication between said conduit and said container, said connecting means comprising:

a first member comprising a top end configured for frictional and removable engagement with said one end of said conduit, said top end having a plurality of steps about the perimeter of said top end, and a bottom end of said first member having a radial flange, said first member carrying a plurality of tangs intermediate said top end and said bottom end and having a first set of guide and bearing surfaces adjacent said tangs;

a second member configured for engagement with the outer diameter of said neck portion, said second member comprising a shoulder means engageable with said tangs for providing frictional engagement between said first and second members and having a second set of guide and bearing surfaces inwardly of said shoulder means, said first and second sets of guide and bearing surfaces being in tracking relationship with each other to allow rotation between and first and second members; and a sealing means positioned between said flange and said neck portion for preventing leaking between said connecting means and said neck portion;

said conduit, said connecting means, and said container being configured such that fluid is urged from said container and through said conduit, by the force attributable to gravity, when said container is disposed above said connecting means and said conduit.

* * * * *